United States Patent [19]

Burke

[11] 4,396,489

[45] Aug. 2, 1983

[54] METHOD AND APPARATUS FOR DEASHING COAL LIQUEFACTION EFFLUENTS

[75] Inventor: Francis P. Burke, Bethel Park, Pa.

[73] Assignee: Conoco Inc., Stamford, Conn.

[21] Appl. No.: 366,735

[22] Filed: Apr. 8, 1982

Related U.S. Application Data

[63] Continuation of Ser. No. 933,359, Aug. 14, 1978, abandoned, which is a continuation-in-part of Ser. No. 861,086, Dec. 15, 1977.

[51] Int. Cl.[3] ..... C10G 1/04

[52] U.S. Cl. ..... 208/8 LE; 208/177

[58] Field of Search ..... 208/8 LE, 177

[56] References Cited

U.S. PATENT DOCUMENTS

| | | | |
|---|---|---|---|
| 4,075,080 | 2/1978 | Gorin | 208/8 |
| 4,077,881 | 3/1978 | Snell | 210/83 |
| 4,138,224 | 2/1979 | Gorin | 44/23 |

*Primary Examiner*—Delbert E. Gantz
*Assistant Examiner*—Lance Johnson
*Attorney, Agent, or Firm*—Dale Lovercheck; William A. Mikesell, Jr.

[57] ABSTRACT

An improved method and apparatus for deashing an effluent slurry from a coal liquefaction process is provided. A mixture of relatively coarse coal-derived solids and a precipitating solvent is stirred with the effluent slurry to form hard, discrete agglomerate pellets of improved settling rates.

4 Claims, 2 Drawing Figures

METHOD AND APPARATUS FOR DEASHING COAL LIQUEFACTION EFFLUENTS

This is a continuation of application Ser. No. 933,359, filed Aug. 14, 1978, which is an application is a continuation-in-part of my earlier filed application, U.S. Ser. No. 861,086, entitled "Deashing of Coal Liquefaction Effluents" filed Dec. 15, 1977.

This invention relates to a process and apparatus for the liquefaction of coal by means of solvent extraction; and more particularly, to the removal of the residual solids from the liquid effluent obtained by such liquefaction. The residual solids are those solids which did not dissolve in the coal solvent under the selected conditions of extraction. Their removal is sometimes conveniently referred to as "deashing".

The importance of efficient removal of residual solids from coal liquefaction effluents cannot be overstressed. Present processes for solids removal such as filtration and sedimentation are inherently restricted by the fine size of the residual solids. For example, a filter feed with 95 percent of the residual solids in the minus 10 micron range is typical. In fact, in most cases the major portion of the solid particles is sub-micron in size. By adding certain liquids, known as anti-solvents, to the liquefaction effluent, a selected portion of the coal extract is precipitated. The precipitate flocculates the fine solids, thereby increasing the effective particle size and thus facilitating separation.

The primary object of the present invention is to improve upon the effectiveness and efficiency of removal of the residual solids from coal liquefaction effluent slurries.

In accordance with the present invention, an improvement in the removal of suspended solids from coal liquefaction effluent slurries is provided. The improvement, in its broadest aspects, comprises the addition of relatively coarse, coal-derived solids to the liquefaction effluent slurry in conjunction with extract precipitation while turbulently agitating the resulting mixture in the liquid phase, whereby hard, discrete agglomerates larger than the suspended solids are formed from said suspended solids, the added coarser solids and the precipitated portion of the extract, the latter serving as the binder. The amounts of added solids and precipitated extract, respectively, are correlated with the amount of suspended solids to produce the desired agglomerates or pellets.

Figure 1:
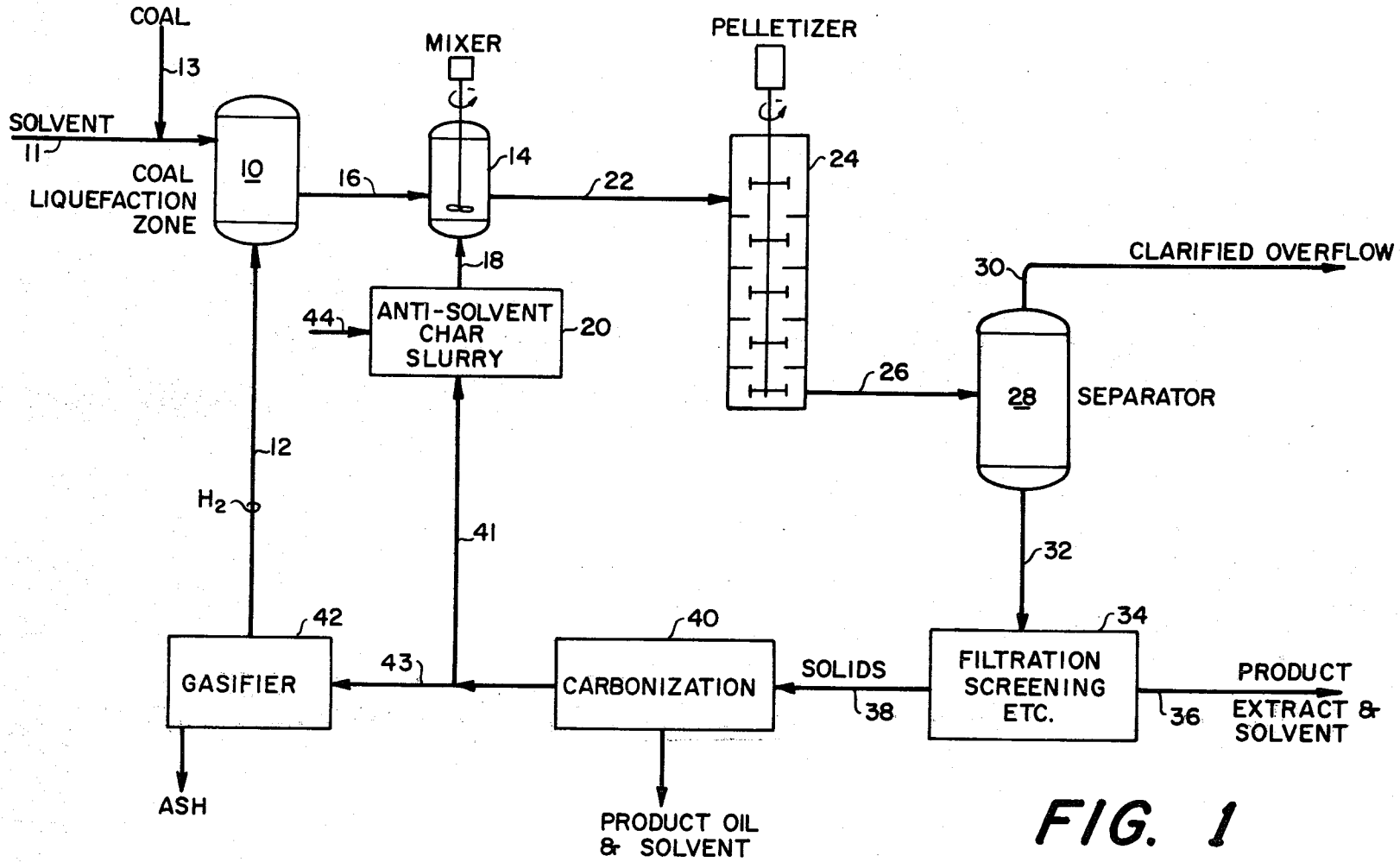

FIG. 1 discloses an embodiment of the present invention; and

Figure 2:
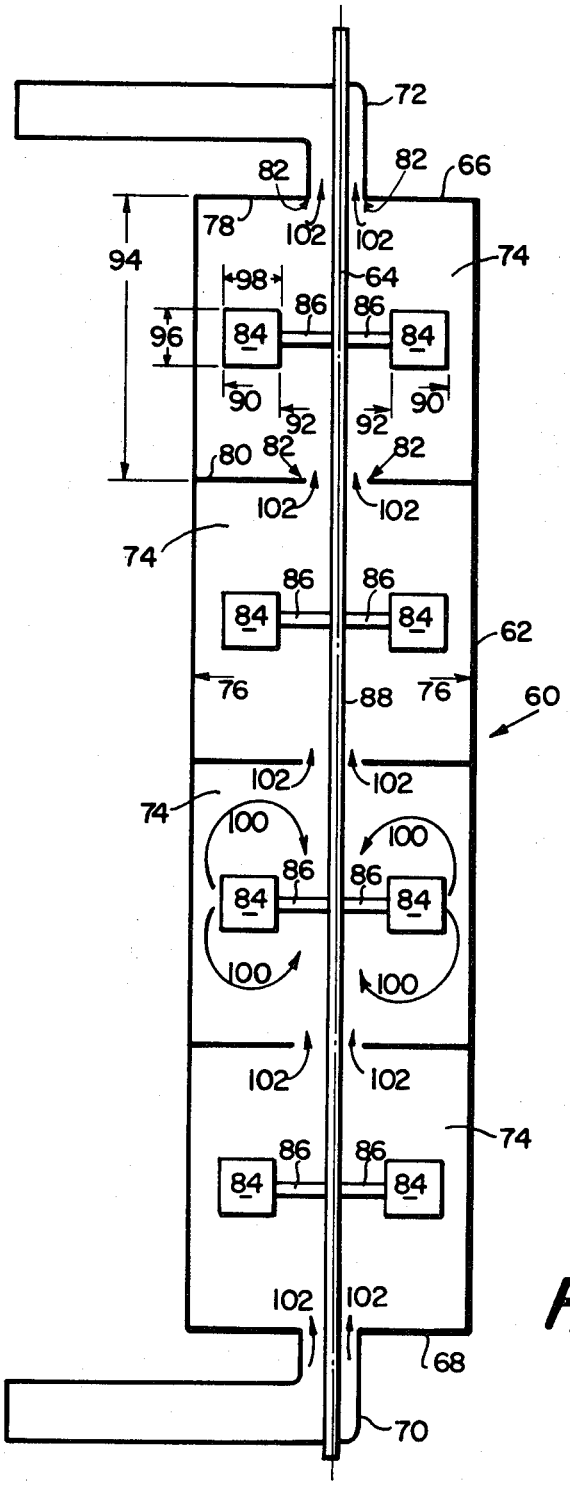

FIG. 2 discloses an agglomeration vessel useful in the practice of the present invention.

The coal liquefaction effluent slurry leaves the coal liquefaction zone at an elevated temperature, generally between 300° C. and 500° C. It comprises a solution of the dissolved coal (extract) in the coal liquefaction solvent, in admixture with the residual solids. The relative amounts of extract and solids are dependent upon the feed coal, the selected coal solvent, and the conditions of extraction, all now well known to the man skilled in the art, and as such, not a part of this invention. The solids, however, universally contain particles which are suspended in the solution; and as previously stated, it is very difficult to separate them from the solution.

Some of the coal solvent may be removed from the hot coal liquefaction slurry, if desired, before the slurry is introduced into the solids separation zone. This is desirable if there is also present in the effluent slurry some distillable coal extract, particularly any which boils below the coal solvent, and at or near the boiling point of the subsequently added anti-solvent. The effective separation of the anti-solvent and the coal solvent for recycle to their respective operations is thus facilitated.

The anti-solvent is generally added to the hot liquefaction slurry prior to introduction into the solids separation zone. The particular anti-solvent is selected both in kind and amount, in a manner now well known, to cause precipitation in the solids separation zone of a fraction of the extract to serve as a binder in the production of agglomerates that separate rapidly from the extract solution.

I have found that the formation of agglomerates is improved when relatively coarse coal-derived solids are added to the coal liquefaction slurry under high shear mixing conditions ($N_{Re}$ greater than $10^4$ and a vessel turnover rate greater than 50 $min.^{-1}$) in a hot solids separation zone. These solids may be added in admixture with the anti-solvent and promptly stirred to maintain them and the residual undissolved coal solids in suspension during the precipitation of a portion of the extract to serve as binder for the solids. The amount, density and size of solids added in conjunction with the amount of precipitated extract and agitation conditions determine the size and shape of the agglomerates formed which incorporate the residual undissolved coal solids. The particle size of the added solids is of course somewhat larger than that of the suspended residual solids. The amount may be as much as that already present in the coal liquefaction slurry. By suitable adjustment of the relative amounts of residual solids, added solids, and precipitated extract, accompanied by suitable conditions of high shear mixing in the solids separation zone, hard, discrete pellets 1–10 mm in diameter, generally spherical in form, can be made which, upon separation, are suitable as feedstock to fixed bed gasifiers or the like.

The solids used in my improvement as additivies to the separation zone may suitably be produced in the coal liquefaction process itself, for example, by low temperature carbonization or coking of solids or liquids, especially those which are low in value.

An agglomerating vessel adapted to accomplish high shear mixing of the residual solids, added solids and precipitated extract to produce agglomerates is described hereinafter.

The method of separation and any subsequent treatment of the agglomerates form no part of this invention.

Referring to FIG. 1, solvent extraction of the coal is conducted in a coal liquefaction zone 10. The liquefaction solvent which is introduced into zone 10 via a conduit 11 has a normal boiling point in excess of 200° C. and is preferably a hydrogen donor. A suitable solvent is a hydrocarbon oil which consists essentially of partially hydrogenated polycyclic hydrocarbons, including naphthenic hydrocarbons which are liquid under the temperature and pressure of hydroconversion. Mixtures of these hydrocarbons are employed and are derived from intermediate or final steps of the process of this invention. Those hydrocarbons or mixtures thereof normally boiling between about 200° C. and 475° C. are particularly preferred.

The ratio of liquefaction solvent to coal (introduced via a conduit 13) in coal liquefaction zone 10 is between 0.1 and 10. The liquefaction may be accomplished in the presence of molecular hydrogen and a suitable hydrogenation or hydrocracking catalyst. A hydrogen-containing gas may be introduced into coal liquefaction zone 10 by way of a hydrogen inlet line 12 which may consist of several inlets appropriately spaced over the zone. Coal liquefaction zone 10 is operated under conditions at which a major portion of the coal rapidly undergoes conversion to liquid and gaseous products. Zone 10 is maintained at a temperature between about 250° C. and 500° C. with a total pressure ranging between 500 and 4000 p.s.i.g. The preferred temperature range is between about 350° C. and 450° C. The partial pressure of molecular hydrogen, if used, in the reactor is between 400 and 4000 p.s.i.a. The hydrogen is injected into zone 10 at a rate sufficient to maintain this hydrogen partial pressure and the desired amount of hydrogen in solution in the liquids in zone 10. Generally, the injection rate is in the range between 6000 and 75,000 standard cubic feet (s.c.f.) per U.S. ton of reactants charged to zone 10. The preferred hydrogen injection rate is between 25,000 and 75,000 s.c.f. per ton of reactants. The rate of coal charged per effective cubic foot of reactor volume is between 15 and 250 pounds per hour.

In coal liquefaction zone 10, coal, liquefaction solvent, hydrogen and catalyst are in intimate association. At reaction conditions, when the coal liquefies, hydrogen aids in the formation and stabilization of new molecules. This liquefaction of a major portion of the coal is further aided by the liquefaction solvent. The hydrogen consumption to simply form the molecules at the time of liquefaction depends on the convertible carbon content of the coal and has been estimated to be less than 1.5 pounds of hydrogen per 100 pounds of coal solids. Additional hydrogen is consumed in partially hydrogenating intermediately formed liquid, and in the hydrocracking thereof. In a hydroconversion process such as the present one, the hydrogen consumption will generally range between 0.5 pound and 15 pounds per hundred pounds of reactant. The hydrogen consumption rate depends on hydrogen partial pressure, temperature, residence time, catalyst activity and composition of the reactants.

The vapor components of the liquefaction product are removed by any suitable vapor handling system. A gas stream composed predominantly of hydrogen is usually recycled to coal liquefaction zone 10 for further reaction with the coal and liquids contained therein.

After liquefaction of the coal has been satisfactorily achieved, the effluent slurry product is transferred to a stirred mixer 14 through a conduit 16. At this point, the slurry product consists essentially of a solution of coal extract in the liquefaction solvent, and undissolved solids. The solids are made up of coarse and fine particulate solids, the latter being difficult to separate from their suspension in the liquid medium, even at high temperatures where the viscosity of the liquid is less.

The effluent slurry product is vigorously mixed in mixer 14 with a slurry of char and anti-solvent (precipitating solvent) introduced by a conduit 18 from an anti-solvent/slurry preparation plant 20. The anti-solvent may be any material which causes a portion of the dissolved extract to precipitate. A suitable precipitating solvent is an aliphatic or naphthenic hydrocarbon which boils within the range of 75° to 200° C. It is miscible with the liquefaction solvent but does not readily dissolve the benzene-insoluble components of the coal liquefaction product. The char (produced in a manner later described) is ground into a 325×28 mesh size range and slurried in the precipitating solvent in plant 20. The quantities of char and anti-solvent used depend on the solids content of the extraction effluent. In general, the amount of char is equal to from about 0.1 to about 2.0 times the amount of residual solids in the effluent. The anti-solvent should generally precipitate a portion of the extract equal in amount to about 20 to about 50 percent by weight of the combined char and the residual solids. The precise amount required for effective agglomeration or pelletization in the subsequent step is readily determined empirically.

After a short residence time in mixer 14, the mixture passes through a conduit 22 into an agglomeration vessel 24 (pelletizer). Vessel 24 is a multi-stage baffled impeller-stirred vessel fitted with four baffles and stirred by 6-bladed disc turbine impellers. While the drawing shows the slurry entering the top of vessel 24, this is not necessary, and a bottom feed may be preferred. In fact, vessel 24 may be divided into a sequence of single-stage vessels without significantly affecting the nature of the process. The important feature of vessel 24 is that its agitation is turbulent. That is, the individual impeller Reynolds numbers ($N_{Re}$) should exceed $\sim 10^4$ and the vessel turnover rate (R) should exceed 50 $min.^{-1}$.

The pelletized (agglomerated) slurry leaves vessel 24 and passes through a conduit 26 into a separator 28 which may be simply a settling zone or a system of hydroclones. A clarified overflow is withdrawn through a conduit 30, while a concentrated pellet-laden underflow is drawn off through a bottom draw-off conduit 32 to a suitable final clarification zone 34 which may be a filter or screen, etc. Extract and solvent are recovered through a conduit 36 while the pellets are sent through a conduit 38 to a low temperature carbonization zone 40, which operates at 450° to 525° C. to recover any extract values, and to make char. Some of the latter is recycled to slurry preparation plant 20 through a conduit 41, and the rest may be sent to a gasifier 42 through a conduit 43 to make hydrogen for recycle, as well as other gases for other purposes. Anti-solvent is introduced through a conduit 44 into the slurry preparation plant to form a slurry with the char as previously discussed.

In FIG. 2, an apparatus 60 for agglomerating finely divided solids is shown. Apparatus 60 comprises a vessel 62 having a longitudinal axis 64, a first end 66 and a second end 68. An inlet 70 and an outlet 72 are also provided. Four agglomerating zones 74 are shown. The zones shown are the same, and accordingly, only the top zone will be described in detail, although it should be understood that the remaining three zones are substantially identical. Zones 74 have an outer diameter shown by arrows 76 which coincides with the inner diameter of vessel 62. Each zone has a first end 78 and a second end 80 with each of the ends containing an opening having a diameter shown by the arrows 82 with the opening being centrally positioned in each end for charging materials to the zone and recovering materials from the zone. A shaft 88 is positioned axially through vessel 62 and through the openings 82. Agitator means comprising paddles 84 attached by arms 86 to shaft 88 are also provided. At least one paddle is present in each zone, although it is desired that at least two and, optionally, a plurality of paddles be used in each zone. The paddles are positioned on shaft 88 for rotation within the zone. The rotation can be by a variety of techniques known to those skilled in the art although, as shown, it is anticipated that shaft 88 will be rotated and that paddles 84, being rigidly affixed thereto, will be correspondingly rotated. As paddles 84 are rotated, an outer agitator diameter shown by arrows 90 is defined and an inner agitator diameter shown by arrows 92 is defined by the inner edge of paddles 84.

As shown, feed is introduced into vessel 62 via inlet 70 as shown by arrows 102 and flows upwardly sequentially through each of zones 74 as shown by arrows 102 in a pattern as shown generally by arrows 100 in each of the zones. Arrows 100 are shown in only one zone although it is to be understood that similar flow patterns are accomplished in each of the four zones.

Paddles 84 have a width 96 measured parallel to axis 64 of vessel 62 of at least 1/5 of outer agitator diameter 90. Paddles 84 have a length 98 measured perpendicular to axis 64 of at least ½ of width 96. Desirably, width 96 is from about 0.1 to about 0.35 times outer agitator diameter 90 and desirably, length 98 is from about 0.5 to about 1.5 times outer agitator diameter 90. Outer agitator diameter 90 is equal to at least ½ outer diameter 76 of zone 74, and desirably, outer agitator diameter 90 is equal to from about ½ to about ⅔ outer diameter 76. The length 94 of zone 74 between first end 78 and second end 80 is equal to at least ½ outer agitator diameter 90. Preferably, the length is from about ½ to about twice outer agitator diameter 90. Further, it is desirable that diameter 82 of the openings in ends 78 and 80 of zone 74 be no larger than inner agitator diameter 92. Preferably, diameter 82 is smaller than diameter 92.

While, in some instances, one agglomerating zone 74 may be sufficient, it is preferred that a plurality of zones be used. The number of zones to be used will be determined primarily by the difficulty of agglomerating the particular solids contemplated. While it is difficult to generalize in this area, it is pointed out that the agglomeration of such solids is known to those skilled in the art and that clearly a sufficient number of zones can be provided to provide the desired degree of agglomeration as known by those skilled in the art.

In the practice of the present invention, the feed, i.e. mixtures of coal extract, liquefaction solvent, anti-solvent, finely divided solids and char is charged to vessel 62 either via inlet 70 with recovery being through outlet 72 or the feed may be charged through line 72 and recovered through line 70. In other words, the flow through the vessel can be either upward or downward. While it is considered to be less desirable than either upward or downward, the flow could be horizontal, although in all cases it is preferred that the apparatus be operated full of liquid. The particular configuration of the vessel and the relative sizing of the components of the vessel result in substantial agitation of the mixture in each zone with the flow being generally as shown by the arrows 100 so that the mixture is circulated on the average several times in each zone with only minor quantities of the mixture passing from the zone to the next zone. To achieve this objective, the diameter 82 of the openings in the ends of the zones is desirably smaller than inner agitator diameter 92 so that as the mixture is urged outwardly by paddles 84, it encounters the outer wall of zone 74 and is deflected as shown by the arrows 100 back around and outwardly again. Such flow patterns result in a minimized tendency for agglomerates to accumulate and plug or otherwise impede the flow of material through vessel 62 while at the same time allowing for substantially "plug" flow throughout the length of vessel 62. Desirably, the diameter 82 of the openings is just sufficient to allow the passage of the amount of material flowing through vessel 62. While the cross sectional area of sections 74 would accommodate greater flow velocities and flow capacities, the flow is controlled by the small openings which are intentionally kept small so that agitation in each of the zones proceeds independently of the agitation in the other zones with minimal or no back mixing. Thus, turbulent mixing can be achieved in each zone without substantial back mixing since the flow is in one direction and into the zone through a relatively small opening with the primary flow in the zone being as shown by arrows 100. The agitation in zones 74 should be turbulent and desirably the individual impeller Reynolds numbers ($N_{Re}$) should exceed $10^4$. It is desirable that the agglomeration be accomplished in vessel 62 in the shortest residence time consistent with good agglomeration.

As noted above, the indivual impeller Reynolds numbers, ($N_{Re}$) should exceed $10^4$. The agitation in the vicinity of the impellers, paddles, etc. must be vigorous to produce the desirable agglomerate pellets of the present invention. Further, the agitation in the vessel as a whole must be vigorous. This agitation parameter hereinafter referred to as the vessel turnover rate (R) is defined more fully hereinafter and must be greater than 50 $min.^{-1}$ and preferably greater than 75 $min.^{-1}$. Both the individual impeller Reynolds number and the vessel turnover rate must be within the proper ranges to produce the desired product agglomerate pellets. Further, the presence of finely divided carbonaceous solids is necessary in conjunction with the use of proper agitation as set forth above.

In the use of vessel 62, the product stream recovered can be passed to settling, in the case of the agglomeration of ash from extract, with the settling rate being greatly improved over that observed with merely flocculated solids. Optionally, filtration could be used to remove the larger agglomerates prior to settling although it is anticipated that in most instances it will be found desirable to proceed directly to a settling zone with the entire product from vessel 62.

In the practice of the present invention, the use of high shear agitation in combination with the addition of finely divided carbonaceous solids results in the production of agglomerates which are relatively hard discrete particles which are readily recovered by filtration, centrifuging, decanting, cyclones or the like. By contrast, when lower agitation rates are used either with or without char addition, or when no char is added, the agglomerates produced have tended to be more of the nature of flocculated material and relatively soft and deformable. Such agglomerates are more difficult to recover since they tend to "blind" filters, desintegrate easily upon handling and the like.

Suitable high shear agitation is provided by Reynolds number values equal to at least $10^4$ for the individual impellers. Desirably, the Reynolds number range is from about $10^4$ to about $10^7$.

Suitable amounts of char are from about 0.1 to about 2.0 times the residual undissolved coal solids present in the mixture. A preferred range is from about 0.5 to about 2.0 times the undissolved solids.

While the use of paddles has been shown in the apparatus described, it should be understood that propellers, impellers and the like can also be used so long as the agitation ranges set forth are met.

The apparatus described above has been designed to be effective in producing such agglomerates from such feedstocks in either continuous or batch processes and as noted above is useful either for upward or downward flow.

Having thus described the invention by reference to certain of its preferred embodiments, it is pointed out that the embodiments described herein are illustrative rather than limiting in nature and that many variations and modifications are possible within the scope of the present invention. Such modifications and variations may be considered obvious and desirable by those skilled in the art based upon a review of the foregoing description of preferred embodiments and the following examples.

EXAMPLES

All pelletizing tests used a liquefaction effluent produced under the conditions given in Table I. The coal-derived solid used was LTC char, ground to −28 mesh unless otherwise stated. Decane was used as the anti-solvent in every run. In every run, the char and extraction effluent were charged to a 2-liter Parr autoclave and heated to 600° F. Decane, preheated to ~400° F., was then added, resulting in a temperature drop of about 35° F. The system was then heated to 600° F. and the run timing started. At the end of the predetermined run time, the autoclave inventory was allowed to flow over a 28 mesh screen into a lower vessel.

TABLE I

| Liquefaction Conditions | |
|---|---|
| Coal | Western Kentucky #9-14 |
| MF[1] Coal Rate, lb/hr | 450 |
| Slurry Concentration, Wt. % Coal | 38.5 |
| Reactor Temperature, °F. | |
| Input | 790 |
| Exit | 825 |
| Total Gas Feed Rate, SCFH | 5300 |
| %$H_2$ in Gas | 85 |
| MAF[2] Conversion, Wt. % | 92 |
| Wt. % Sulfur in Filtered Extract | 0.8 |
| Space Rate, lb coal/hr/ft$^3$ | 50 |

[1]moisture-free
[2]moisture- and ash-free

TABLE II

| | A | B |
|---|---|---|
| Char feed (wt. % residual solids) | 85.0 | 0 |
| Wt. Ratio, binder/solids | 0.50 | 0.45 |
| Residence time (min) | 120 | 120 |
| Vessel turnover rate | 212 | 223 |
| $N_{Re}$ | $5.2 \times 10^4$ | $5.2 \times 10^4$ |

Effect of Char Addition

The data in Table II demonstrates the effect of char addition to the liquefaction effluent prior to its introduction into the agglomeration zone. In both of runs A and B, the residence time and agitation parameters are fixed at a level known to be acceptable for pelletizing. In Run A, ground char (325×65 mesh) was added to the extraction effluent along with enough anti-solvent to precipitate binder equal to 50 percent by weight of the combined char and residual solids. In Run B, no char was added. Run A produced hard, well-defined spherical pellets. Run B did not produce pellets. The product of Run B was a mass of finely divided solids, essentially equivalent in size to the feed char.

TABLE III

| | Run C | Run D | Run E |
|---|---|---|---|
| Residence time (min.) | 120 | 115 | 132 |
| Vessel turnover rate | 176 | 184 | 41 |
| $N_{Re}$ | $5.4 \times 10^4$ | $6.7 \times 10^4$ | $4.9 \times 10^4$ |
| Agitator | 6-bladed disc-turbine | impeller | 2-bladed paddle |
| Wt. ratio, binder/solids | 0.45 | 0.42 | 0.45 |
| Char fed, Wt. % of residual solids | 83.4 | 98.0 | 83.5 |

Effect of Agitation Intensity

In Table III, data are given which show the necessity for high agitation rates in the liquid phase coal liquefaction residue pelletizing process. The reactor residence time was held near 120 minutes, i.e. 120, 115 and 132 minutes respectively, and agitation was turbulent, i.e. at $N_{Re} > 10^4$. The binder/solids ratio was also held constant in runs C and E and varied only slightly in run D. The char feed, as a percentage of the residual solids, was held within an acceptable range.

The three runs differed primarily in the type of agitation employed. In Runs C and D, a 6-bladed disc-turbine impeller was used. In Run E, a 2-bladed paddle was used.

Runs C and D produced hard, well-defined spherical oblate and prolate pellets. Run E produced finely-divided, loaf-like solids opposed to the discrete pellets produced in Runs C and D. The pellets are hard, discrete pellets and pour freely from the screen.

The agitation intensity is given by the impeller Reynold's number $$N_{Re} = \frac{\rho D^2 N}{\eta}$$

where: $\rho$ is the liquid specific gravity, D is the impeller diameter, N is the impeller revolution rate, and $\eta$ is the liquid viscosity. $N_{Re}$ is greater than $10^4$ for all three systems. The vessel turnover rate is given as $$R = \frac{nViN}{V_t}$$

where: n is the number of impeller blades, Vi is the volume swept out by the impeller in one revolution, $V_t$ is the total liquid volume, and N is the impeller revolution rate. It can be shown, by the appropriate arithmetic substitutions that, $$R = \Phi\theta N_{Re}$$

where $\Phi$ is a factor describing the tank geometry, $\theta$ is a factor describing the impeller geometry and $N_{Re}$ is the impeller Reynolds number. Therefore, for identical mixing configuration, the vessel turnover rate and the impeller Reynolds number are proportional. It should be apparent then, that for the same geometrics, the same turnover rate (R) and the impeller Reynolds number provide equivalent measures of agitation intensity. For different configurations, the vessel turnover rate is the preferred measure of agitation intensity.

As the data in Table II show, acceptable products are made with vessel turnover rates of 176 min$^{-1}$ and 184 min$^{-1}$. In Table I, a vessel turnover rate of 212 min$^{-1}$ was shown to be acceptable, if char solids are added to the pelletizing slurry. In Table II, a vessel turnover rate of 41 $min^{-1}$ is clearly unacceptable.

Having thus described the invention, I claim:

1. A method of separating residual solids from liquid coal liquefaction product comprising the sequence of steps as follows:

(a) carbonizing a mixture of carbonaceous liquid and coal-derived solids at 450° to 525° C. (842° to 977° F.) to form carbonized solids, said carbonized solids being substantially larger than said residual solids, (b) grinding said carbonized solids to form ground carbonized solids in the 325×28 mesh size range, (c) providing a coal liquefaction product slurry, (d) providing a precipitating solvent, (e) adding ground carbonized solids consisting essentially of said solids from (b) and said precipitating solvent to said coal liquefaction product slurry, to form a separation mixture comprising (i) liquid coal liquefaction product (ii) liquid precipitating solvent (iii) residual solids, 95 percent of said residual solids being less than 10 microns in size and (iv) said added ground carbonized solids, (f) agitating said separation mixture to form readily screenable pellets each said pellet being from 1 to 10 mm in size and thus substantially larger than said added ground carbonized solids, each of said pellets comprising a portion of said residual solids and a portion of said ground carbonized solids, said agitating of said separation mixture being at high shear mixing conditions, said mixing being at a rate such that the impeller Reynolds number ($N_{Re}$) is greater than $10^4$ and such that the vessel turnover rate (R) is greater than 50 $min^{-1}$ so that the amount of deposit precipitated by the precipitating solvent serves to bind together said suspended residual solids and said added ground carbonized solids to form said pellets, said pellets being hard, discrete not adhering together at about 316° C. (600° F.) and nonfloccular;

(g) screening said pellets from said liquid coal liquefaction product whereby said liquid coal liquefaction product is separated from said residual solids, said residual solids comprising a portion of each of said pellets.

2. The method of claim 1 wherein said ground carbonized solids are added in amount of between 0.1 to 2.0 times the amount of said residual solids.

3. The method of claim 1 wherein said pellets used as said coal-derived solids and are carbonized and ground to form said ground carbonized solids.

4. The method of claim 2 wherein said ground carbonized solids are added in an amount of between 0.5 and 2.0 times the amount of said residual solids.

* * * * *